US011175001B2

(12) United States Patent
Gaytan

(10) Patent No.: US 11,175,001 B2
(45) Date of Patent: Nov. 16, 2021

(54) AUGMENTED LIGHTING SYSTEM

(71) Applicant: Emmanuel Gaytan, Midland, TX (US)

(72) Inventor: Emmanuel Gaytan, Midland, TX (US)

( * ) Notice: Subject to any disclaimer, the term of this patent is extended or adjusted under 35 U.S.C. 154(b) by 0 days.

(21) Appl. No.: 16/585,629

(22) Filed: Sep. 27, 2019

(65) Prior Publication Data

US 2020/0103083 A1 Apr. 2, 2020

Related U.S. Application Data

(60) Provisional application No. 62/738,195, filed on Sep. 28, 2018.

(51) Int. Cl.
*F21S 4/10* (2016.01)
*F21Y 115/10* (2016.01)

(52) U.S. Cl.
CPC ..... *F21S 4/10* (2016.01); *F21Y 2115/10* (2016.08)

(58) Field of Classification Search
CPC ..... F21S 4/10; F21S 4/00
See application file for complete search history.

(56) References Cited

U.S. PATENT DOCUMENTS 6,023,127 A * 2/2000 Huang ..... F21V 19/0005 313/318.01
6,238,062 B1 * 5/2001 Hsu ..... F21V 19/006 362/267
6,328,593 B1 * 12/2001 Chang ..... H01R 4/2406 439/419
6,354,719 B1 * 3/2002 Pan ..... F21V 19/0005 362/249.01
6,382,813 B1 * 5/2002 Huang ..... F21V 19/0005 362/249.01
6,799,867 B1 * 10/2004 Cheng ..... F21V 19/0005 362/249.14
6,910,918 B1 * 6/2005 Driver ..... F21V 21/002 439/542
7,025,490 B1 * 4/2006 Tseng ..... F21V 19/0005 362/653
7,029,161 B1 * 4/2006 Lin ..... H01R 33/09 362/249.15
7,626,321 B1 * 12/2009 Gibboney, Jr. ..... F21V 19/0005 313/318.01
8,870,404 B1 * 10/2014 Chen ..... F21S 4/10 362/123
2002/0109989 A1 * 8/2002 Chuang ..... F21S 4/10 362/654
2018/0187843 A1 * 7/2018 Wei ..... F21S 4/10

* cited by examiner

*Primary Examiner* — Zheng Song
(74) *Attorney, Agent, or Firm* — Leavitt Eldredge Law Firm

(57) ABSTRACT

An augmented lighting system improves the contribution to an area where a lighting strand is used by providing ambiance, festiveness, environmental appeal or the like through the configuration of the body of the casing that holds the lights. The improved casings complement the light provided and remove the common feel of the fixtures.

1 Claim, 4 Drawing Sheets

AUGMENTED LIGHTING SYSTEM

BACKGROUND

1. Field of the Invention

The present invention relates generally to lighting systems, and more specifically, to a stringed light system that enables the placement and display of a series of bulbs.

2. Description of Related Art

Lighting systems are well known in the art and are effective means to create illumination to area where they are used. For example, FIG. 1 depicts a conventional stringed light system 101 having a cord 103 with fixtures 105 attached along the length thereof. The fixtures 105 hold bulbs 107. During use, the cord 103 is placed on an object such as a building, plant or the like and electricity travels the cord 103 to activate the bulbs 107 in the fixtures 105. The bulb 107 radiate light to the area around the system 101.

One of the problems commonly associated with system 101 is limited use. For example, the cord 103 and fixtures 105 enable the functionality of the system 101 but do not contribute to the environment created by the light from the bulbs 107. Attempts to improve this have resulted in covers for the bulbs 107, new materials and colors for the cord 103 and fixtures 105 and so on.

Accordingly, although great strides have been made in the area of stringed light systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
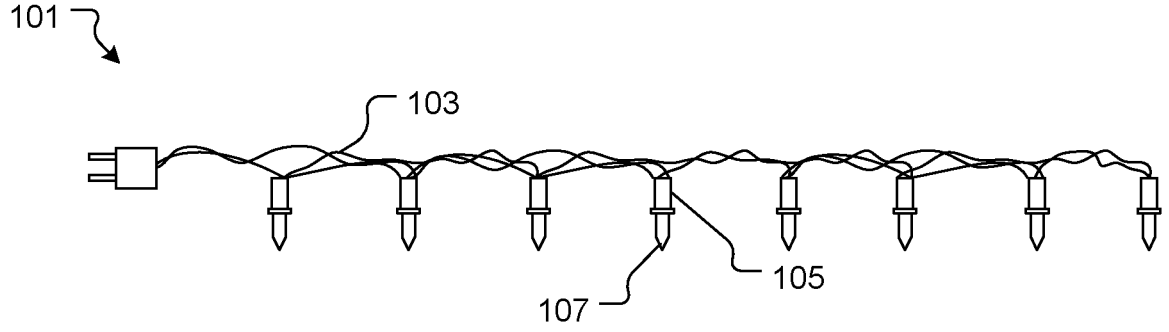
FIG. 1 Prior Art
FIG. 1 is a front view of a common stringed light system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional stringed light systems. Specifically, the invention of the present application alters the fixtures to increase the use of the lights to change the area where they are used. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
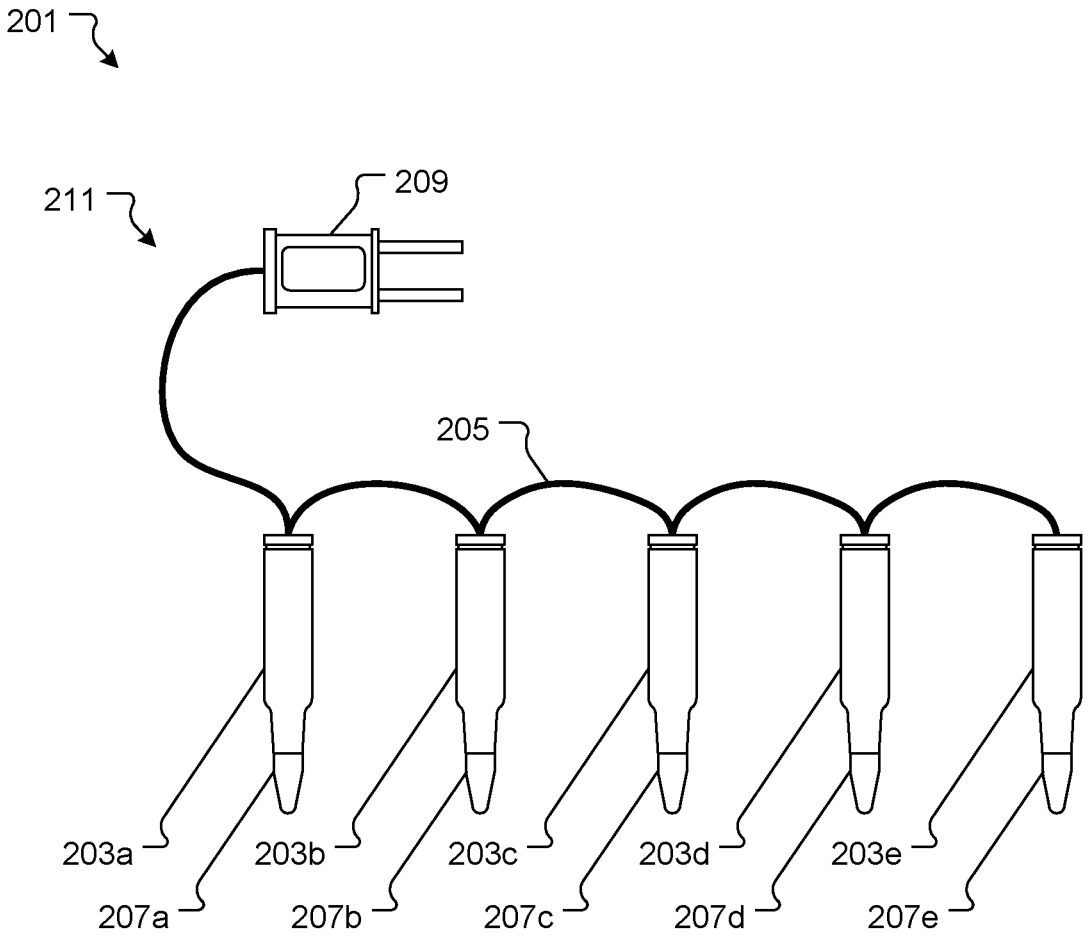
FIG. 2 is a front view of an augmented lighting system in accordance with a preferred embodiment of the present application.

Referring now to the drawings wherein like reference characters identify corresponding or similar elements throughout the several views, FIG. 2 depicts a front view of an augmented lighting system in accordance with a preferred embodiment of the present application. It will be appreciated that system 201 overcomes one or more of the above-listed problems commonly associated with conventional stringed light systems.

In the contemplated embodiment, system 201 includes a series of casings 203 having a set of wiring 205 attached therebetween. Each casing having an LED bulb 207 therein. A first end 211 of the wiring 205 having a power adapter 209 attached there to and in electrical communication with the wiring 205 and LED bulbs 207.

Figure 3:
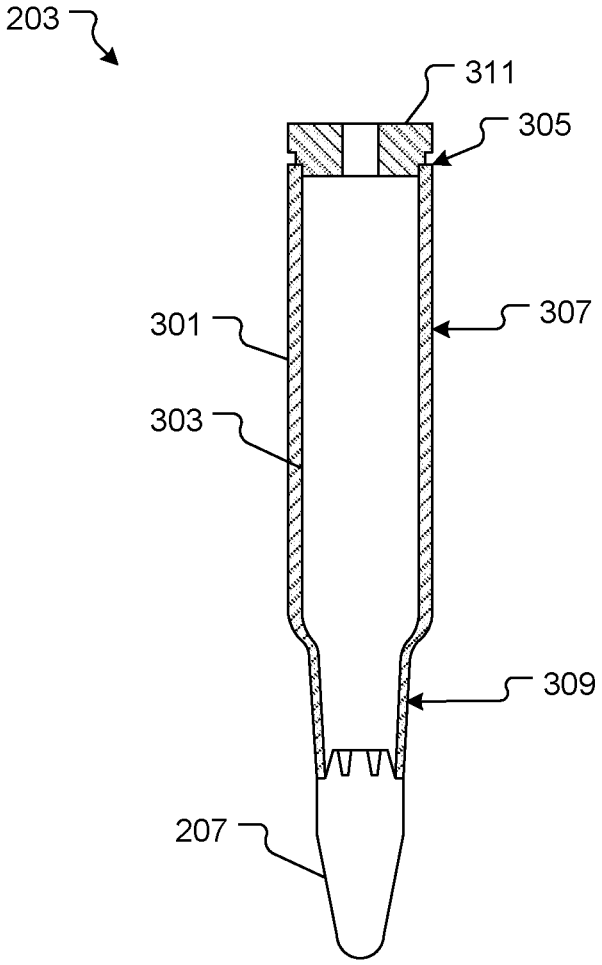
FIG. 3 is s cross-sectional front view of the casing of FIG. 2.

Referring now to FIG. 3 a casing 203 is depicted having a body 301 enclosing a space 303 wherein the wiring 205 electronically attaches to the bulb 207. The casing 203 having a stopper 311 placed in the end 305 thereof opposite the bulb 207 to close the space 303.

While the present embodiment depicts the body 301 having a first diameter 307 that is larger than a second diameter 309 so as to represent shell any configuration is contemplated and will be disclosed.

It should be appreciated that one of the unique features believed characteristic of the present application is that the body 301 of casing 203 enhances the ambiance of created by the system 201.

Figure 4:
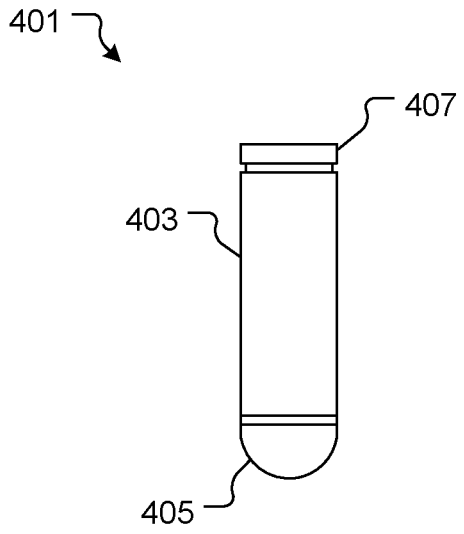
FIG. 4 is a front view of an alternative embodiment of the casing of FIG. 2.
Figure 5:
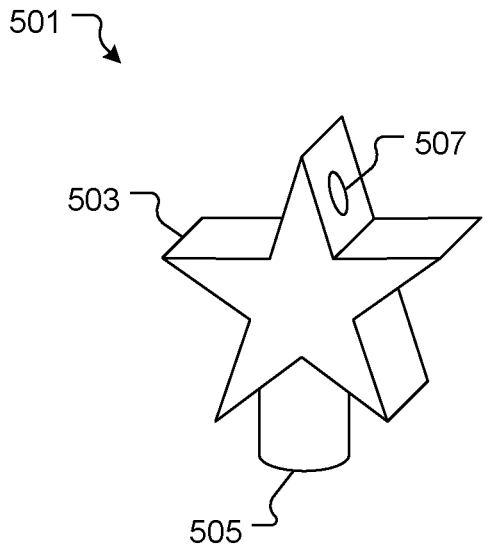
FIG. 5 is a perspective view of another alternative embodiment of the casing of FIG. 2.

Alternative embodiments of the body 301 of the casing 203 are depicted in FIGS. 4 and 5. Embodiment 401 of FIG. 4 having a body 403 with a consistent cross section between the bulb 405 and stopper 407. Embodiment 501 of FIG. 5 having a body 503 of geometric configuration where a bulb 505 extends out of one side and another having an access hole 507 through which the wiring can pass.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. An augmented lighting system comprising:

at least one casing attached to a set of wiring, the at least one casing having a body extending from a first end to a second end and enclosing a space;

the body having a first portion with a first diameter and a second portion with a second diameter, the first diameter being greater than the second diameter;

a bulb attached to the first end of the body and the second portion of the body and in electrical communication to the set of wiring, the bulb protruding from the second portion of the body;

a stopper engaged with the body at the second end opposite the bulb and engaged with the first portion of the body, the stopper having:

a first portion with a first diameter;

a second portion with a second diameter;

a hole extending through the first portion and the second portion and into the space of the at least one casing;

wherein the first diameter is less than the second diameter; and wherein the first portion is engaged within the space of the at least one casing at the second end of the body;

wherein the space enclosed by the body is positioned between the bulb and the stopper;

wherein the body of the casing contributes to the ambiance created by the system.

* * * * *